US005862634A

United States Patent [19]

Berger et al.

[11] Patent Number: 5,862,634

[45] Date of Patent: Jan. 26, 1999

[54] BEARING DEVICE

[75] Inventors: Xaver Berger; Karl Radimersky, both of Aichach; Thomas E. Lernet, Augsburg, all of Germany

[73] Assignee: MEA Meisinger, Stahl and Kunststoff GmbH, Germany

[21] Appl. No.: 789,311

[22] Filed: Jan. 23, 1997

[30] Foreign Application Priority Data

Jan. 23, 1996 [DE] Germany ..... 196 02 306.8

[51] Int. Cl.[6] ..... E04B 1/21

[52] U.S. Cl. ..... 52/73; 52/79.9; 52/36.4; 52/127.1; 52/189; 52/236.6; 52/251; 52/704

[58] Field of Search ..... 52/704, 699, 251, 52/259, 236.6, 236.8, 298, 73, 79.9, 79.11, 127.1, 111, 252, 582.1, 364, 189

[56] References Cited

U.S. PATENT DOCUMENTS

| | | | |
|---|---|---|---|
| 3,733,757 | 5/1973 | Scott . | |
| 4,903,448 | 2/1990 | Compton . | |
| 4,951,438 | 8/1990 | Thoresen | 52/704 X |
| 5,355,642 | 10/1994 | Palamarz | 52/73 |
| 5,660,020 | 8/1997 | Reay | 52/704 X |

FOREIGN PATENT DOCUMENTS

| | | | |
|---|---|---|---|
| 178449 | 5/1954 | Austria | 52/704 |
| 2283269 | 3/1976 | France . | |
| 1840139 | 10/1961 | Germany . | |
| 3531441 | 3/1987 | Germany . | |
| 3738784 | 11/1988 | Germany . | |
| 3408556 | 4/1990 | Germany . | |
| 4002661 | 8/1991 | Germany . | |
| 4409477 | 9/1995 | Germany . | |
| 9514456 | 12/1995 | Germany . | |
| 4429605 | 2/1996 | Germany . | |

OTHER PUBLICATIONS

International Search Report of German Application No. 196 02 306.8 dated July 18, 1996.

*Primary Examiner*—Robert Canfield
*Attorney, Agent, or Firm*—Richard A. Speer; Mayer Brown & Platt

[57] ABSTRACT

A load bearing device is disclosed, which includes a girder to support the load. The girder is accommodated in a housing connected to the load and can be pulled out from the house to engage a girder receptacle, which is fastened to a wall or the like. By means of this bearing device, it is possible to mount prefabricated structural elements such as stairway landings in easy manner.

29 Claims, 3 Drawing Sheets

BEARING DEVICE

BACKGROUND

The invention concerns a load bearing device, by means of which structural elements can be fastened to a wall or the like. In particular, the bearing device according to the invention is suitable for anchoring a stairway landing to a building wall.

Bearing devices for fastening of structural elements to walls are known in the most diverse form. Two-piece bearing devices are known for fastening stairway landings to building walls; these have a girder which is taken up by a girder receptacle. Usually this girder receptacle has solid-borne soundproofing, so that no solid-borne sound can be transmitted from the stairway landing to the building wall.

In order to achieve this, the girder receptacle is appropriately insulated in the areas which come into contact with the building wall. The following procedure is used to anchor a stairway landing. First, the girder receptacle is inserted into the building wall. Since stairwells are often made of mix-in-situ concrete, the girder receptacle is simply anchored in the formwork and then cast with the concrete. Of course, the girder receptacle can also be built into a brick wall.

When a sufficient number of girder receptacles for secure supporting of the load have been built into the stairwell walls, the formwork and the necessary reinforcement are constructed for the stairway landing. After this, the girders are inserted into the girder receptacles and positioned in the formwork so that a sufficient connection between the girder and the stairway landing is guaranteed. Next, concrete is poured into the forms, thus producing the stairway landing. The concrete binds with the girder and thus ensures the anchoring of the stairway landing to the walls of the building. In order to avoid bridges which carry sound, the stairway landing must be prevented from having direct contact with the walls of the building. Therefore, the connection of the stairway landing to the wall of the building should only occur through the solid-borne soundproofed girder receptacle or other insulating elements.

Corresponding bearing devices are used not only for anchoring stairway landings, but also for connecting any desired cantilever plates and also other structural elements.

SUMMARY OF THE INVENTION

The basic purpose of the invention is to create a bearing device by means of which loads such as structural elements or the like can be easily and cheaply anchored to walls or the like.

This purpose is accomplished by the features claimed.

According to the invention, a bearing device is created which has a girder to take up a load, for example, a stairway landing. The girder is extensibly contained in a housing, so that it can be brought into engagement with a girder receptacle which can be fastened to a wall or the like. This design makes it possible to place the load in the desired position and then, simply by extending the girder from the housing and placing the girder in the receptacle, to anchor it to the wall or the like.

The advantages associated with this novel bearing device shall be explained hereafter by means of an example. With the new bearing device, a stairway landing can be created and constructed in the simplest manner. The significant simplification lies in the fact that, thanks to the new type of anchoring, the stairway landing can now be prefabricated and no longer need be constructed on site. This means that the stairway landing is fabricated independently of the construction site and the necessary number of housings of the bearing device are integrated in the stairway landing. Later on, the finished stairway landing is put in the desired position at the job site and anchored by extending the girders and inserting them into the receptacles introduced into the walls.

The housing can be provided with strengthening elements, in order to improve the transmission of forces and enable a light construction of the housing itself.

In order to improve the connection of the housing to the load or structural element being anchored, the housing can be provided with reinforcement elements. A design with two curved rebars, having a straight segment extending underneath the housing, is especially suitable for concrete elements.

In certain applications it can be advantageous to provide the housing with spacers for orientation. If the housing is to be cast in a concrete element, the housing can be better oriented in the formwork for the concrete element by these spacers.

For better guidance of the girder in the housing, the latter can have contact segments or contact elements which can be placed in contact with the girder It has been found to be relatively expensive to produce the girder and the housing which accommodates it in a precisely flush manner. For this reason, it is advantageous to allow rather large tolerances and to provide instead a sufficient guidance of the girder by suitable contact elements. The contact elements can be joined to the housing or also formed by segments of the housing itself, which are deformed.

In most applications, a certain gap is formed in the assembled condition between the anchored structural element and the wall or the like, to which the structural element is anchored. In many cases, such a gap is even desirable, in order to accomplish an acoustical decoupling of the joined elements. For example, this is the case with stairway landings. Often, however, this gap is not supposed to remain, but rather is closed up after the installation. This can be done by means of a sealing element. The sealing element can also be used when filling the gap with a casting compound, which will be described more closely when discussing the specific sample embodiment. It is advantageous to provide the housing with a receptacle element to accommodate such a sealing element. The sealing element can be provided such that it seals a gap between housing and girder receptacle.

In order to join the housing to the sealing element, the housing can have a receptacle element with a recessor gap, in which the sealing element can be placed. An especially easily handled structure is obtained if the sealing element is extendable from the gap of the receptacle element. In this case, there is no independent handling of the sealing element and it can be easily furnished along with the housing.

In order to create a sufficient seal between the sealing element and the girder receptacle, the girder receptacle can be provided with a special sealing segment, which can be brought into tight contact with a sealing element of the housing.

In order to prevent unwanted materials from getting into the housing, at least one end surface of the housing can be closed by means of a cap. Hollow sections with a basically rectangular or square cross section have proven to be good as the girder In most instances, the girders should be of steel. But of course, the girder can also be made of a plastic material or fiber composites.

In order to easily ensure that the girder has been sufficiently extended or inserted into the girder receptacle, the latter can have a marking in a particular place which is easily checked This marking can also be in the form of a borehole which is provided in the girder. If a borehole is used, this has the advantage that the position of the girder can be checked even without visual contact, e.g., by introducing a suitable pin into the borehole. This pin can also remain in the borehole as a sign that the girder has been properly installed.

In order to allow immediate recognition of whether the girder has been placed deeply enough in the girder receptacle, the latter can have a shoulder against which a check element thrusts, being connected to the girder. Thus, for example, the aforesaid pin can be thrust against a shoulder so that the correct positioning of the girder can be checked at all times with no major expense, at a glance.

The pulling of the girder out from the housing can be simplified by means of a lengthwise pull element which is joined to the girder. A flexible band or a rope works well as a pull element. The pull element must be fastened in the rear area of the girder, for example, on the end surface of the girder away from the girder receptacle. This fastening can be done with an end cap, which is placed on the end surface of the girder. It is easiest to clamp the pull element between the end cap and the girder.

A pull element can also be used to prevent the girder from falling out of the housing. For this, the end of the pull element not used to pull out the girder can be fastened to the housing, so that the girder can only be pulled out of the housing until this end becomes taut and, thus, it cannot fall completely out of the housing. Advantageously, the pull element is fastened to the end surface of the housing away from the girder receptacle. For example, the pull element can be fastened to an end cap which is placed on the end surface of the housing.

Of course, a safety arrangement independent of the pull element for pulling out the girder can also be achieved by means of a band or the like, or by means of a different arrangement. Disassembly of the girder from the housing can also be prevented by means of a projection provided in the rear area of the girder, which engages with a detent on the housing when the girder is extended; of course, one must ensure the necessary travel of the girder in order to fit fully in the girder receptacle.

If the girder is pulled out from the housing by means of the pull element, the free end of the pull element can be accommodated in a space of the girder receptacle, so that it does not have to be cut off and does not hang loose, possibly impairing other work.

The girder receptacle can be provided with an element to support the girder. According to this design, a stable support element is used which can easily absorb the forces produced by the girder. This has the advantage that the entire girder receptacle need not be made of a correspondingly high-strength material. This support element can adjoin an elastic element, which absorbs the vibrations produced by the girder, so that these are already dampened in the girder receptacle and a sufficient soundproofing is achieved.

If the girder receptacle is made of a solid-borne sound-proofing material, at least in the areas where forces can be transmitted, the insulating properties can be greatly improved.

The propagation of a fire through the bearing device can be prevented or at least hindered by providing portions of the girder receptacle with a fire-retardant material. This material can be one which swells up under the action of heat, protecting the other structural parts when swollen and thus at least hindering a propagation of the fire or at least delaying a failure of the bearing device by the action of fire. It may be necessary to provide such materials especially in buildings, in order to obey the legal fire prevention provisions.

The girder receptacle can have a cup-shaped part of stable material to accommodate the other elements. This simplifies the handling of the receptacle and the installation of the receptacle, since it is only necessary to create a connection between the cup-shaped part and the wall or the like.

BRIEF DESCRIPTION OF THE DRAWINGS

The invention will now be explained in greater detail by means of two sample embodiments.

DETAILED DESCRIPTION OF PREFERRED EMBODIMENTS

Figure 1:
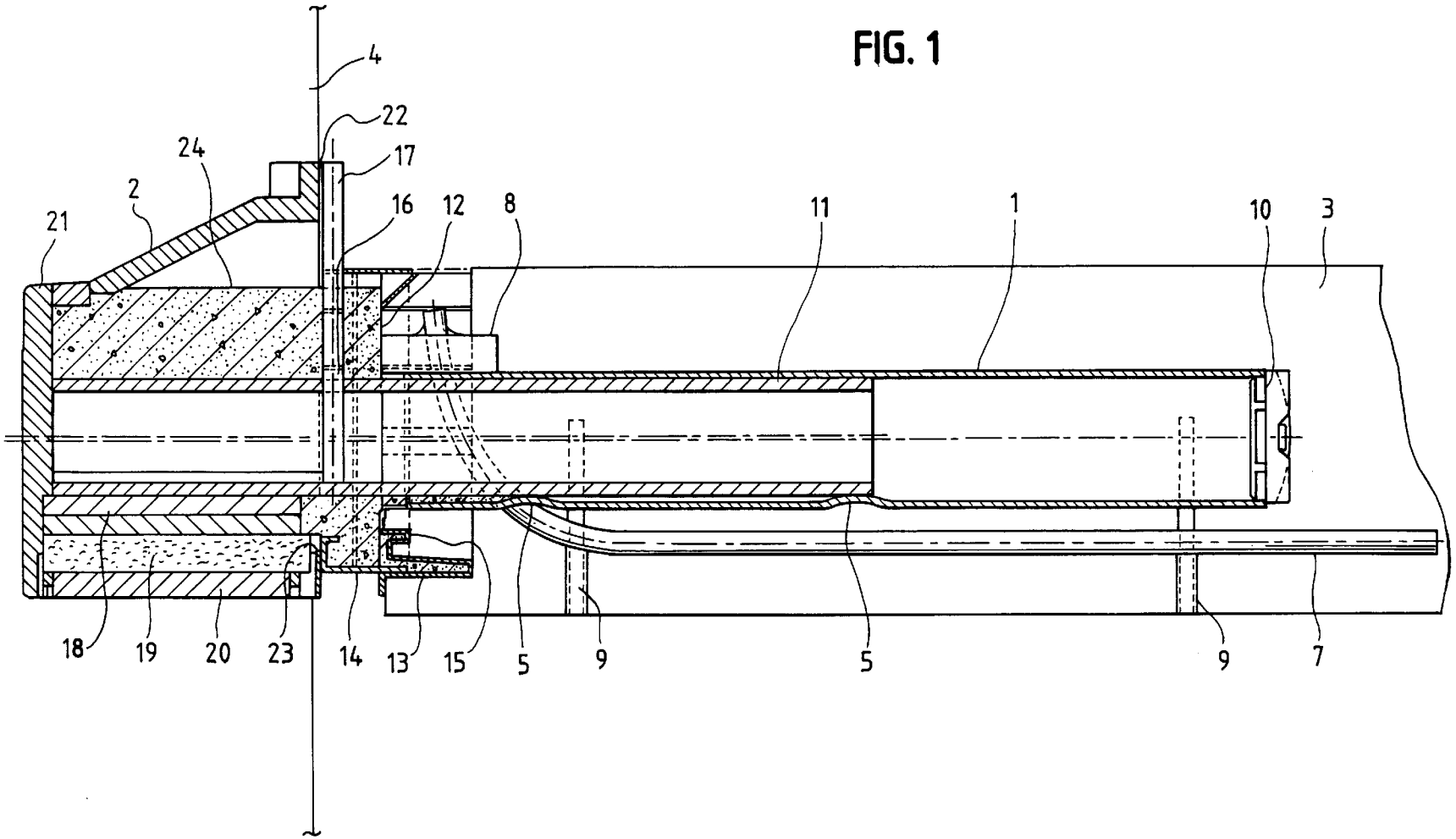
FIG. 1 shows the first sample embodiment with extended girder in lengthwise section.
Figure 2:
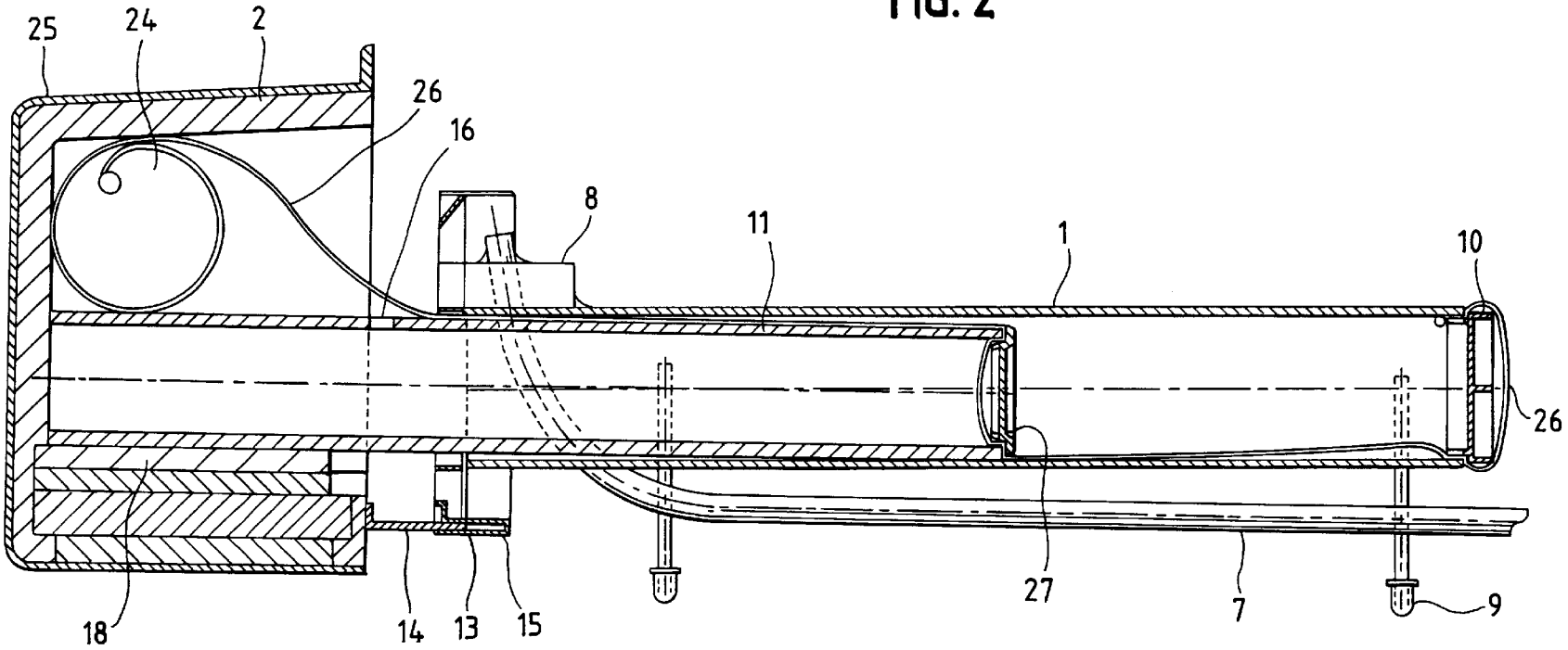
FIG. 2 shows the second sample embodiment with extended girder in lengthwise section.

The bearing device shown has two basic parts. First, the housing 1, which is joined to the element being supported, in the present case, a stairway landing 3, which is only indicated in outline, and second, the girder receptacle 2, which in the present case is installed in a wall 4 of the stairwell, which is also only indicated by a line at the side of the stairway landing 3. Landing 3 constitutes an element of the construction and constitutes a load that both requires support upon vertical elements such as a wall or the like and which, under usual circumstances, also supports additional loads.

The housing 1 accommodates a girder 11, which is depicted as being extended and introduced into the girder receptacle 2. As can be seen from the drawing, the inner cross section of the housing 1 is larger than the outer cross section of the girder 11. This play makes it possible to fabricate both parts with a certain tolerance and, thus, at favorable cost. Even so, in order to ensure that the girder is accommodated in the housing 1 with no play, the housing 1 is provided with contact segments 5 on the bottom surface, which reduce the inner cross section of the housing in these areas so much that the girder 11 is accommodated with no play.

In this sample embodiment, the girder 11 and the housing 1 are made of steel. In order to make the contact segments 5, the housing 1 with the girder 11 in place is simply indented with a tool at the locations of the contact segments 5 until the wall of the housing 1 rests against the girder 11.

In the forward region, i.e., toward the girder receptacle 2, the housing 1 is strengthened by means of a thick steel plate as strengthening element 8. Two rebars 7 are welded to this strengthening element 8, extending parallel to each other—so that only one rebar can be seen in FIG. 1. The rebars 7 are positioned as shown and have a curved as well as a straight segment. This form has proven especially good at taking up the forces produced by the stairway landing 3.

At the side of the strengthening element 8 there is provided a sleevelike closure element 12, which closes off the housing 1 from the girder receptacle 2 and can also be used to mount the housing 1 on a formwork to fabricate the stairway landing 3. In the lower region of the closure element 12 there is a receiving element 13 to accommodate a sealing element 14. The receiving element 13 has two slotlike spaces 15, into which the sealing element 14, of corresponding configuration, can be inserted. In the representation shown, the sealing element 14 has been pulled out and abuts against a shoulder 23 of the girder receptacle 2, in order to close the gap between housing 1 and receptacle 2 and between stairway landing 3 and building wall 4. The function of this sealing element 14 will be explained more closely later on.

On the upper side of the girder 11 there is a borehole 16 provided as a marker, into which a pin 17 can be inserted when the girder 11 is in its final position. In this position, the pin 17 thrusts against a shoulder 22 of the girder receptacle 2, so that the positioning of the girder 11 can be easily checked.

The end surface of the housing 1 away from the girder receptacle 2 is closed by means of an end cap 10. To facilitate the orientation of the housing 1, spacers 9 are provided on the bottom side of the housing 1, the function of which will be explained later on.

The girder receptacle 2 has a supporting element 18 to absorb the forces of the girder 11, which in the sample embodiment described is implemented in the form of a two-piece steel plate. This support element 18 adjoins a fire-retardant material 19, to protect the structural parts of the bearing device in event of a fire, which normally spreads from underneath, i.e., also from the bottom in the drawing, in order to prevent a failure of the bearing device as long as possible. The girder receptacle 2 is closed off at the rear, so that it is easy to install and prevents any foreign objects from getting inside. Quite conspicuous in the lengthwise cross section is the rear end wall 21 of the girder receptacle 2, as well as a free space 24 of the girder receptacle 2 on top of the girder 11, the function of which will be explained later on.

The setup and installation of a stairway landing 3 by means of the bearing device according to the invention shall now be explained.

At first, the stairway landing 3 is constructed in concrete regardless of the job site where the landing 3 is to be installed. The housing 1 of the bearing device can be easily positioned at the designed location by means of the sleeve-like closure element 12 and the spacers 9. After this, concrete is poured into the formwork and, thus, the housing 1 is integrated into the resulting stairway landing. The finished stairway landing 3 is taken away with the housing 1 and brought to the job site.

At the job site, the girder receptacle 2 is installed in the building wall 4 in the desired place. The girder receptacle 2, for example, can be provided with fastening means in the forward area, which can be fastened to a formwork, facilitating the installation of the girder receptacle in walls made of concrete. For a masonry wall of stone or brick, the girder receptacle 2 can be easily set in the desired place.

The stairway landing 3 is now placed in the desired position by a crane or lifting device. As soon as the stairway landing 3 has been properly oriented, the girders 11 of the bearing devices integrated in the stairway landing 3 are pulled out from the housings 1 and inserted into the girder receptacles 2. In the first sample embodiment, no pull-out device for the girder is shown. One can use a pulling device as described in the second sample embodiment for this, but the girder can also be forced out of the housing by means of a pressing device.

A corresponding pressing device can be activated by compressed air, which is blown into the rear area of the housing 1 by means of a pressurized air line, which is connected to the housing and is likewise integrated in the stairway landing and brought to one side of the landing. In this case, one uses a girder 11 whose cross section is closed at one spot, so that the air pressure introduced into the rear area of the housing 1 presses the girder 11 out from the housing 1.

In this way, the girder 11 is placed inside the girder receptacle 2. Once the girder 11 is in its final position, a pin 17 can be inserted in the gap which results between the stairway landing 3 and the wall of the building 4, which pin can be inserted into the borehole 16 in the girder 11 if the girder 11 is in the desired end position. If the girder 11 is indeed in its final position, the pin 17 thrusts against the shoulder 22 of the girder receptacle 2 In this way, one can easily check whether or not the girder 11 has reached the predetermined end position.

In order to fill the gap between stairway landing 3 and building wall 4, the sealing element 14 arranged in the receiving element 13 is then pulled out and placed against a shoulder 23 of the girder receptacle 2. In the next work steps the gap is filled from above with a filler material. Since the areas of the girder receptacle 2 which come into contact with the building wall 4 are made of a soundproofing material, the gap can also be filled with concrete or the like, without fear of producing sound-carrying bridges.

When filling up the slot, the space 24 in the girder receptacle 2 above the girder 11 is also at least partly filled with concrete or filler. This ensures that the girder 11 is also fixed at the top in the girder receptacle 2 and can also transmit upwardly directed forces, at least to a certain extent.

The second sample embodiment largely corresponds to the first. Therefore, corresponding structural parts are provided with the same reference numbers and shall not be explained more closely. Instead, the new features and the differences shall now be discussed.

The second sample embodiment makes use of no contact segments, but instead puts up with a certain play between girder 11 and housing 1. Because of this play, the danger of the girder 11 accidentally sliding out of the housing 1 is, of course, particularly great. This is prevented in this sample embodiment by a special arrangement which also allows an easy pulling out of the girder 11 and insertion in the girder receptacle 2.

This device has a pull element in the form of a flexible band 26, whose one end is fastened to an end cap 10, which is placed on the right end surface of the housing 1. The band 26 leads from this end to the right end of the girder 11, where it is connected by means of another end cap 27 to the right end of the girder 11. The length of the band 26 in the housing 1 between the two end caps 10, 27 is measured so that the girder 11 is not hindered in being inserted as far as its end position in the girder receptacle 2, yet the girder cannot fall out of the housing 1.

The band 26 is led out from the housing 1 from the end cap 27 of the girder by the free end between housing 1 and girder 11 at the left side. Once the stairway landing 3 is properly oriented, one need only pull on the free end of the band 26 to pull the girder 11 out of the housing 1 and introduce it into the girder receptacle 2. The free and pulled out end of the band 26 can be placed in the free space 24 of the girder receptacle 2 above the girder 11.

The gap between stairway landing 3 and building wall 4, as well as the space 24, can then be sealed up.

The girder receptacle 2 differs only slightly from the girder receptacle 2 according to the first sample embodiment and therefore is not described more closely. Yet attention is called to the one-piece cup-shaped element 25, which accommodates all of the structural parts of the girder receptacle 2 and thus simplifies the handling of the bearing device.

Figure 3:
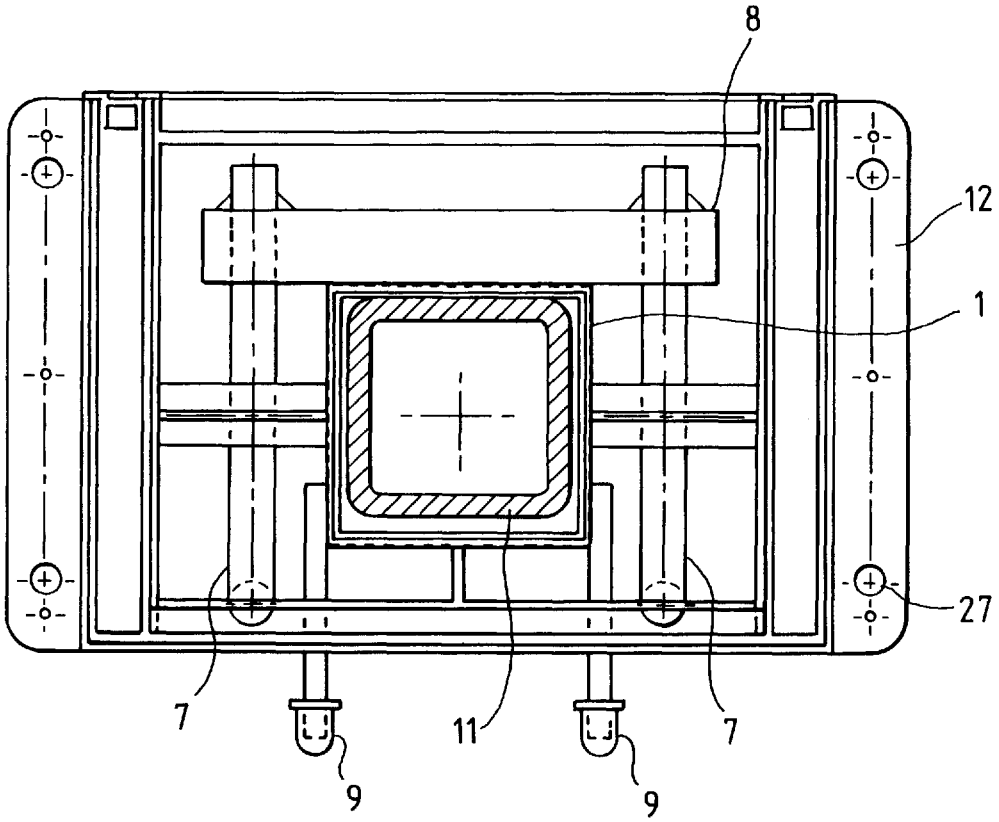
FIG. 3 shows the first sample embodiment in cross section.

FIG. 3 shows the bearing device in a cross section, where the two reinforcement elements 7 and the spacers 9 which are welded to the housing 1 are conspicuous. Furthermore, one can see the housing 1 with the girder 11 accommodated therein and the strengthening element 8. The sleevelike connection element 12 is more visible than in the lengthwise section, being provided with holes 27 to allow an easy assembly on formwork.

We claim:

1. A load bearing structure for attachment to vertical support elements, the structure comprising:

(a) a load element to be supported, the element having upper, lower and edge surfaces;

(b) a girder housing contained within the load element and extending from an edge into the interior thereof;

(c) a girder slidably disposed within the girder housing;

(d) a strengthening element operably associated with the girder housing adjacent the end of the housing nearer the load element edge;

(e) at least one elongated reinforcing element joined at substantially one and thereof to the strengthening element and extending from into the load element beneath the girder housing; and (f) a girder receptacle that can be fastened to vertical support elements such that the girder is slidably extended from the girder housing to engage the girder receptacle and support the load thereby.

2. The load bearing of claim 1, wherein the housing is connected to two curved reinforcement elements, each reinforcement element having a straight segment that extends underneath the housing.

3. The load bearing of claim 1, wherein the housing is provided with spacers for orientation.

4. The load bearing of claim 1, wherein the housing has contact elements for contact with the girder.

5. The load bearing of claim 1, wherein the housing is provided with a receiving element to accommodate a sealing element.

6. The load bearing of claim 5, wherein a sealing element is positioned to seal off a gap between the housing and the girder receptacle.

7. The load bearing of claim 5, wherein the receiving element has a recess in which the sealing element can be inserted.

8. The load bearing of claim 7, wherein the sealing element is extendable from the recess of the receiving element.

9. The load bearing of claim 1, wherein at least one end surface of the housing can be closed off by an end cap.

10. The load bearing of claim 1, wherein the girder is hollow.

11. The load bearing of claim 1, wherein the girder and the housing essentially have a rectangular cross section.

12. The load bearing of claim 1, wherein the girder has a marking to identify a particular location along the girder.

13. The load bearing of claim 12, wherein the marking is a borehole.

14. The load bearing of claim 1, wherein a lengthwise pull element is joined to the girder such that the girder can be pulled out from the housing.

15. The load bearing of claim 14, wherein the pull element is a flexible band.

16. The load bearing of claim 14, wherein the pull element is fastened to an end surface of the girder distal from the girder receptacle.

17. The load bearing claim 16, wherein the pull element is fastened to an end cap which is mounted on the end surface of the girder.

18. The load bearing of claim 14, wherein the pull element is fastened to the housing.

19. The load bearing of claim 18, wherein the pull element is fastened to an end surface of the housing distal from the girder receptacle.

20. The load bearing of claim 19, wherein the pull element is fastened to an end cap which is mounted on the end surface of the housing.

21. The load bearing of claim 14, wherein at least one portion of the pull element can be accommodated in a space of the girder receptacle.

22. The load bearing of claim 1, wherein the girder receptacle has a stable support element to support the girder.

23. The load bearing of claim 22, wherein an elastic element adjoins the support element directly or indirectly.

24. The load bearing of claim 1, wherein at least a portion of the girder receptacle is made from a solid-borne sound-proofing material.

25. The load bearing of claim 1, wherein areas of the girder receptacle are provided with a fire-retardant material.

26. The load bearing of claim 1, wherein the girder receptacle has a cup-shaped piece of stable material to accommodate the other elements.

27. The load bearing of claim 1, wherein the girder receptacle has a sealing segment, which can be brought into sealing contact with a sealing element of the housing.

28. The load bearing of claim 1, wherein the girder receptacle has a shoulder which can thrust against a check element, which can engage with the girder.

29. The load bearing of claim 1, wherein the girder receptacle has a free space which is located above the girder when the girder is inserted therein.

* * * * *